US007140716B2

(12) United States Patent
Jensen et al.

(10) Patent No.: US 7,140,716 B2
(45) Date of Patent: Nov. 28, 2006

(54) MECHANICAL LOCK MECHANISM FOR LOCKING WIPER/PRINTHEAD

(75) Inventors: Darryl I. Jensen, Woodburn, OR (US); Marcia D. Haney, Oregon City, OR (US); Ernest I. Esplin, Sheridan, OR (US)

(73) Assignee: Xerox Corporation, Stamford, CT (US)

( * ) Notice: Subject to any disclaimer, the term of this patent is extended or adjusted under 35 U.S.C. 154(b) by 400 days.

(21) Appl. No.: 10/878,530

(22) Filed: Jun. 29, 2004

(65) Prior Publication Data

US 2005/0285895 A1 Dec. 29, 2005

(51) Int. Cl.
*B41J 2/165* (2006.01)

(52) U.S. Cl. ..... 347/33; 347/22

(58) Field of Classification Search ..... 347/23, 347/29, 30, 32, 33
See application file for complete search history.

(56) References Cited

U.S. PATENT DOCUMENTS

| | | | | |
|---|---|---|---|---|
| 5,570,117 | A * | 10/1996 | Karambelas et al. | 347/33 |
| 5,949,462 | A | 9/1999 | Esplin et al. | 347/108 |
| 6,244,686 | B1 | 6/2001 | Jensen et al. | 347/37 |
| 6,692,100 | B1 | 2/2004 | Steinfield et al. | 347/22 |

* cited by examiner

*Primary Examiner*—Juanita D. Stephens
(74) *Attorney, Agent, or Firm*—Oliff & Berridge, PLC

(57) ABSTRACT

A locking mechanism in an image processing device is needed to lock a movable element of the image processing device. In embodiments, the locking mechanism has a support member disposed between the driving element and the movable element, the support member being movable between a first position and a second position, a pivot on the support member about which the support member is able to rotate, and a first rotating member on the support member, the first rotating member rotating when the movable element is moved by the driving element, and the locking mechanism is locked when both the first rotating member is stopped from rotating and the support member is rotated from the first position to the second position about the pivot.

20 Claims, 15 Drawing Sheets

MECHANICAL LOCK MECHANISM FOR LOCKING WIPER/PRINTHEAD

BACKGROUND OF THE INVENTION

1. Field of Invention

The invention relates to systems and methods for locking a wiper/printhead using a lock mechanism.

2. Description of Related Art

Certain types of devices, such as printers or copiers, create an image on a medium, such as paper, by ejecting ink through orifices formed in an orifice plate attached to a printhead onto the medium, or a drum that transfers an image formed on the drum to the medium. In devices that use the drums, a latent image is first formed on the rotating drum and ink is then ejected from the printhead onto the drum. The image, which is eventually transferred to the medium, is in the shape of the latent image formed on the rotating drum.

In devices that eject ink from the printhead, repeated use of the device allows contaminants to form. These contaminants may consist of ink or other debris in the orifices and the orifice plate of the printhead. Accordingly, the printheads must be periodically cleaned by a device, such as a wiper, to remove the contaminants and obtain high quality printed images. One such example of a wiper/printhead is found, for example, in U.S. Pat. No. 5,570,117, the disclosure of which is incorporated by reference herein in its entirely.

In some devices with the wiper/printhead configuration, the drum and the printhead are positioned so that they face each other with a space defined between them. The wiper is disposed in the space between the printhead and the drum, and the wiper is positioned so that the drum is located on the opposite side of the wiper from the printhead. However, during the printing operation of the device, the wiper must be removed from the space to allow the printheads to eject ink onto the drum. Removing the wiper from the space creates an unhindered path for the ink to make contact with the drum.

The wiper is connected to mechanisms that move the wiper away from the space defined by the printhead and the drum. Therefore, the wiper is able to move from a position between the printhead and the drum to a position such that the wiper is not between the printhead and the drum and vice versa. When the wiper is moved away from the space, the drum and the printhead are allowed to face each other without the wiper between them.

In devices with the wiper/printhead configuration, mechanisms allow the printhead to move closer to the drum. During the printing operation, once the wiper is moved away from the space, the printhead mechanisms allows the printhead to move closer to the drum in order to eject ink onto the drum. The printhead mechanism allows the printhead to move toward the drum even when the wiper is still located in the space between the printhead and the drum. During the cleaning operation, the wiper is not removed from the space but the printhead mechanisms allow the printhead to approach, then contact the wiper for cleaning.

The wiper is generally long and narrow and spans the length of the printhead. During the cleaning operation of the devices, the wiper generally traverses the surface of the printhead, for example, from an upper position to a lower position in the vertical direction. The mechanisms that allow the wiper to move away from the space is used to perform the wiper's traversing movement. The wiper is moved to clean the printhead by a wiping motion.

The wiper is moved during the wiping operation from the upper position to the lower position by a driving motor of the printer/copier. The driving motor also drives all the other mechanical systems of the printer/copier. A clutch of the wiper mechanism selectively engages the driving motor in order to move the wiper mechanism so that the wiper mechanism can traverse the surface of the printhead and move away from and into the space.

SUMMARY OF THE INVENTION

The rotation of the driving motor is converted so that the wiper can traverse the surface of the printhead through a series of mechanisms, such as gears. In the wiper mechanism, a pair of rotational mechanisms is used to ensure level travel of the wiper. Without the engagement of the wiper mechanism to the drive motor through the clutch, the wiper mechanism is unrestrained and unintended movement of the wiper may occur.

Unrestrained and unintended movement of the wiper may occur, for example, when the device is transported from one location to another location whereby such movement of the device may cause the wiper and its mechanism to disengage. In such devices, the wiper, which is unrestrained, may unintentionally move from the upper position to the lower position away from the space defined by the printhead and the drum. As a result, the drum and the printhead face each other without the wiper located between them. If mechanisms that control the approach of the printhead towards the drum is also unrestrained, the printhead can then move toward the drum and approach the drum because the moved wiper does not act as a barrier to catch the printhead's movement towards the drum. Further, if the vibration from the relocation or the movement of the device is great, the printhead can slam into the drum without being caught by an intervening wiper. Such unintended contact may damage the drum and/or the printhead.

To lessen or avoid unintended movement of the wiper mechanism when unrestrained or not driven by the drive motor, a mechanism to hold and/or lock the wiper in a desired position may be used.

Therefore, there is a need to reduce the unintended movement of the unrestrained wiper mechanism to reduce or prevent damage to the printhead and/or drum using minimal parts, is low cost, and without extensive further modifications to existing drive systems.

Further, there is a need to lock the wiper head prior to turning off the device, without components being stressed. There is also a need for quickly and reliably locking and unlocking the wiper mechanism. There is a need to ensure that the wiper mechanism is securely in the locked or unlocked positions.

Exemplary systems of this invention include a locking mechanism for use in an image processing device with at least one driving element for driving a movable element, comprising a support member disposed between the driving element and the movable element, the support member being movable between a first position and a second position, a pivot on the support member about which the support member is able to rotate, and a first rotating member on the support member, the first rotating member rotating when the movable element is moved by the driving element, wherein the locking mechanism is locked when both the first rotating member is stopped from rotating and the support member is rotated from the first position to the second position about the pivot.

Exemplary methods of this invention include moving a movable element to a predetermined pre-lock position, setting a predetermined jiggle-down distance for the movable element to move if the locking mechanism is not locked, moving the movable element to an extreme position of travel, and moving the support member from the first position to the second position to lock the movable element.

Exemplary methods of this invention include driving the support member in a forward locking direction to store energy when the support member is in the locked position, at least one of reversing and releasing the clutch while the support member is being driven in the forward locking direction to cause a release of the stored energy, and allowing the support member to move from the locked position to the unlocked position in response to the release of the stored energy.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described with reference to the following figures, wherein.

DETAILED DESCRIPTION OF EXEMPLARY EMBODIMENTS

Figure 1A:
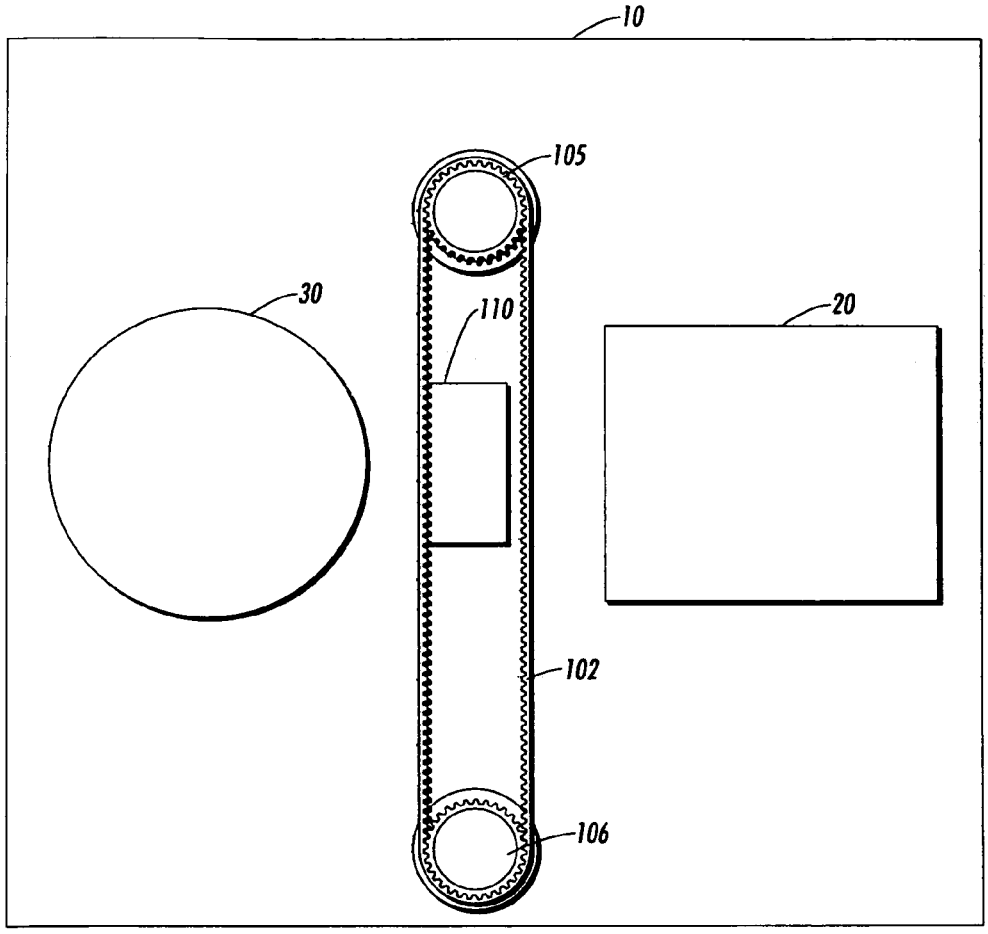
FIGS. 1A–1D show a schematic representation of an exemplary wiper/printhead.

For a general understanding of a wiper/printhead mechanism of a copier/printer in which the features of this invention may be incorporated, reference is made to FIGS. 1A–1D, which depict various key components thereof. Although this invention for locking the wiper/printhead is particularly well adapted for use in such a machine, it should be apparent that the embodiments are merely illustrative. Rather, aspects of this invention may be achieved in any wiper/printhead copier/printer system in which a wiper used is subject to unexpected and unintended movement and/or contact of the wiper with the drum or printhead.

In FIGS. 1A–1D, a copier/printer 10 contains various components which allow production and/or reproduction of printed text and/or images on a medium such as paper. Some of these components are a printhead 20, which is used to eject ink directly onto a drum 30 as shown in FIGS. 1A–1D. Disposed between the printhead 20 and the drum 30 is a positioning system 40 which positions the wiper 110 in various positions to wipe/clean the printhead 20. Mechanism are attached to the printhead 20 that allow movement of the printhead 20.

As shown in FIGS. 1A–1D, the positioning system 40 includes pulleys 105, 106, and a belt 102 that extends between the pulleys 105, 106. The wiper 110 is attached to the belt 102. In various exemplary embodiments, the pulleys 105, 106, and belt 102 are operated to ensure level movement of the wiper 110.

As shown in FIG. 1A, the wiper 110 is in a resting position whereby the wiper 110 is disposed between the printhead 20 and the drum 30. In FIG. 1A, the wiper 110 is shown at rest at about the same level of elevation as both the printhead 20 and the drum 30. The resting position may be assumed immediately after the copier/printer is turned on, or may be a resting or default position after each operation of the copier/printer is completed. Alternatively, the resting position may be assumed upon occurrence of a problem which may hinder and/or prevent the proper operation of the copier/printer. Otherwise, the resting position may simply be a predetermined preferred position of an unlocked positioning system 40.

Figure 1B:
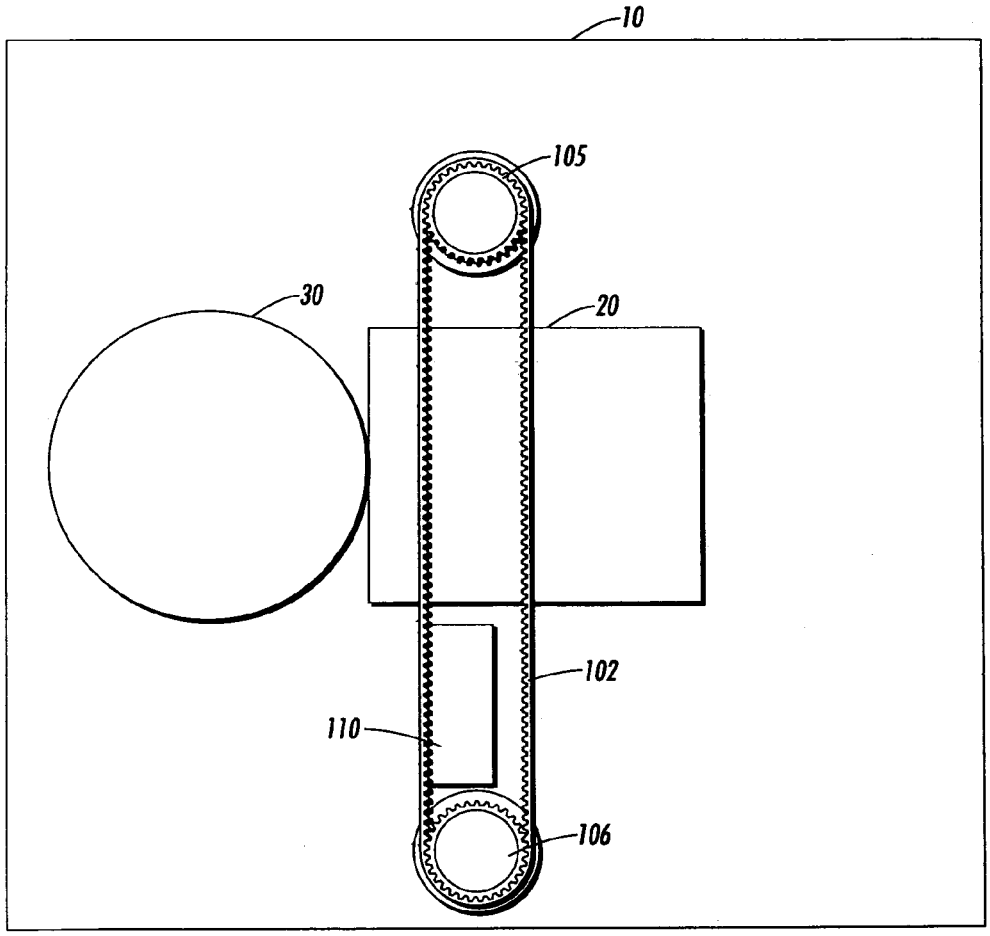

As shown in FIG. 1B, the wiper 110 is in a moved position whereby the wiper 110 is disposed below both the printhead 20 and the drum 30. In the moved position, the wiper 110 is no longer disposed between the printhead 20 and the drum 30, which allows for the printhead 20 to approach the drum 30 and assume the printing operation. As shown in FIG. 1B, the wiper 110 in the moved position is completely clear of the path needed by the printhead 20 to approach the drum 30. To move the wiper from the resting position shown in FIG. 1A to the moved position in 1B, the positioning system 40 is operated. The belt 102 is rotated by the opposing pulleys 105, 106 to lower the wiper 110 from the resting position to the moved position.

During the printing operation shown in FIG. 1B, in conjunction with the lowering of the wiper 110, the printhead 20 is moved to assume the printing operation position shown. In the exemplary embodiment shown in FIG. 1B, the printhead 20 ejects ink onto the drum 30 with a latent image formed thereon so that text and/or image is eventually transferred to a medium.

Figure 1C:
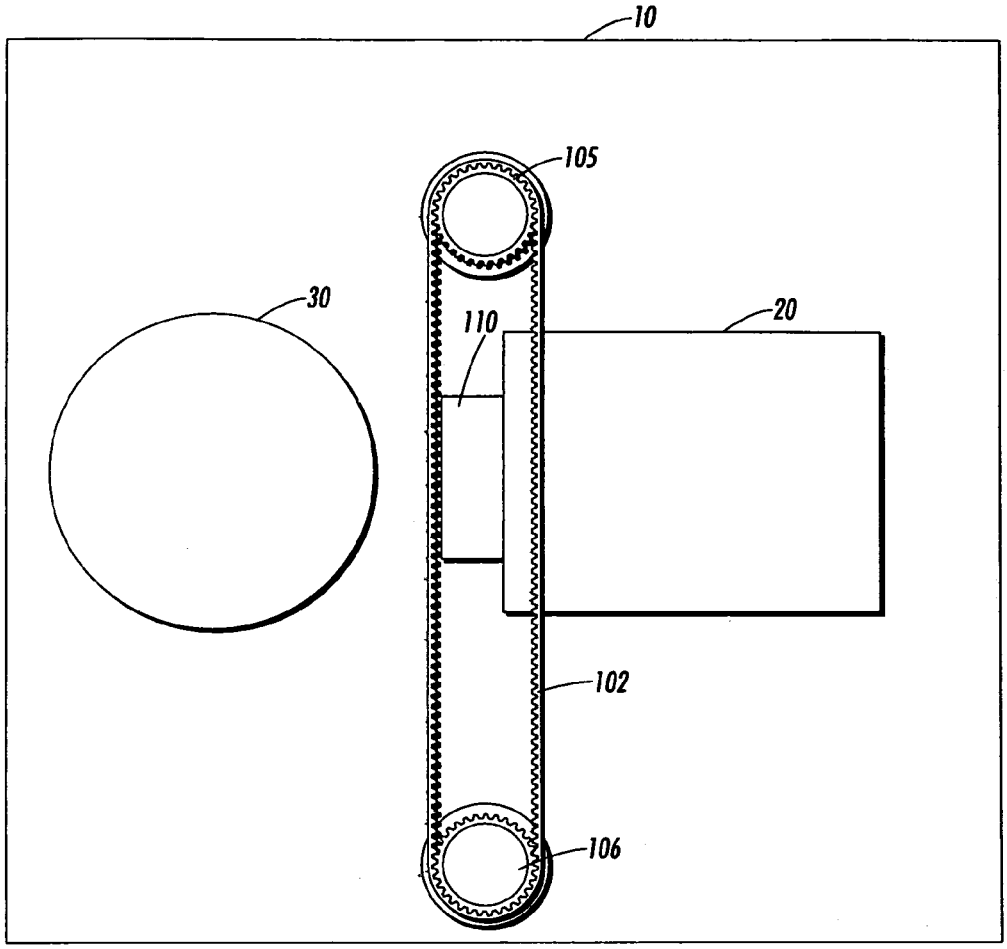

As shown in FIG. 1C, the wiper 110 is in a cleaning position whereby the wiper 110 is disposed between the printhead 20 and the drum 30. In the cleaning position, the wiper 110 is at about the same level of elevation as the printhead mechanism 20 and the drum 30. However, unlike the resting position shown in FIG. 1A, the wiper 110, in the cleaning position, abuts the printhead mechanism 20 as represented in FIG. 1C. In the cleaning position, the wiper 110 is moved in a coordinated manner to wipe the surface of the printhead mechanism 20 which abuts the wiper 110. In the exemplary embodiment shown in FIG. 1C, the wiper is moved from the top of the printhead 20 towards the bottom of the printhead 20 in a wiping motion. The wiper 110 thereby cleans the debris from the surface of the printhead 20.

Figure 1D:
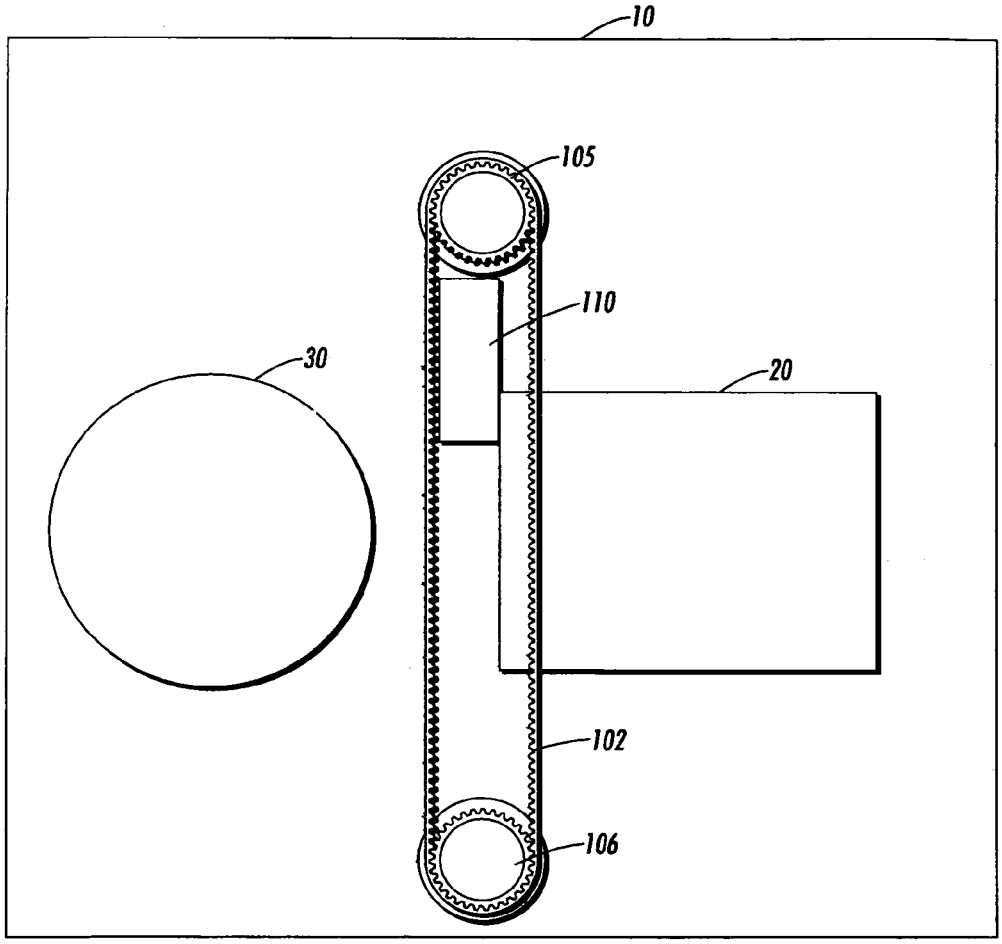

As shown in FIG. 1D, the wiper 110 is at an extreme position of travel whereby the wiper 110 is disposed at a level of elevation somewhat above those of the printhead 20 and the drum 30. In the exemplary embodiment shown, the wiper 110 is at a position where it cannot move further up on the belt and the rotation of the pulleys 105, 106 and the rotation of the belt 102 is stopped. As shown in FIG. 1D, the position of the wiper 110 lessens the possibility of direct contact of the printhead 20 and the drum 30.

Figure 2:
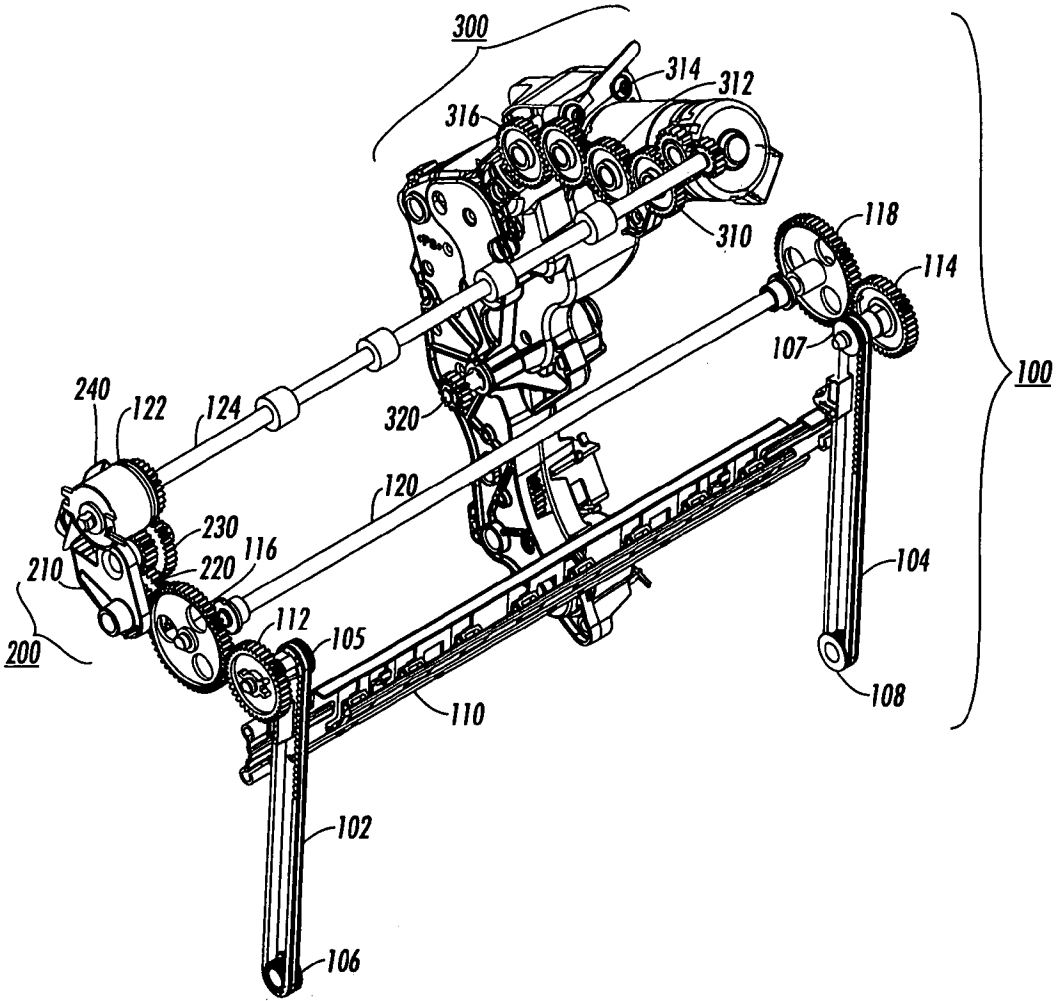
FIG. 2 shows a schematic representation of the locking mechanism according to an exemplary embodiment of this invention.
Figure 3:
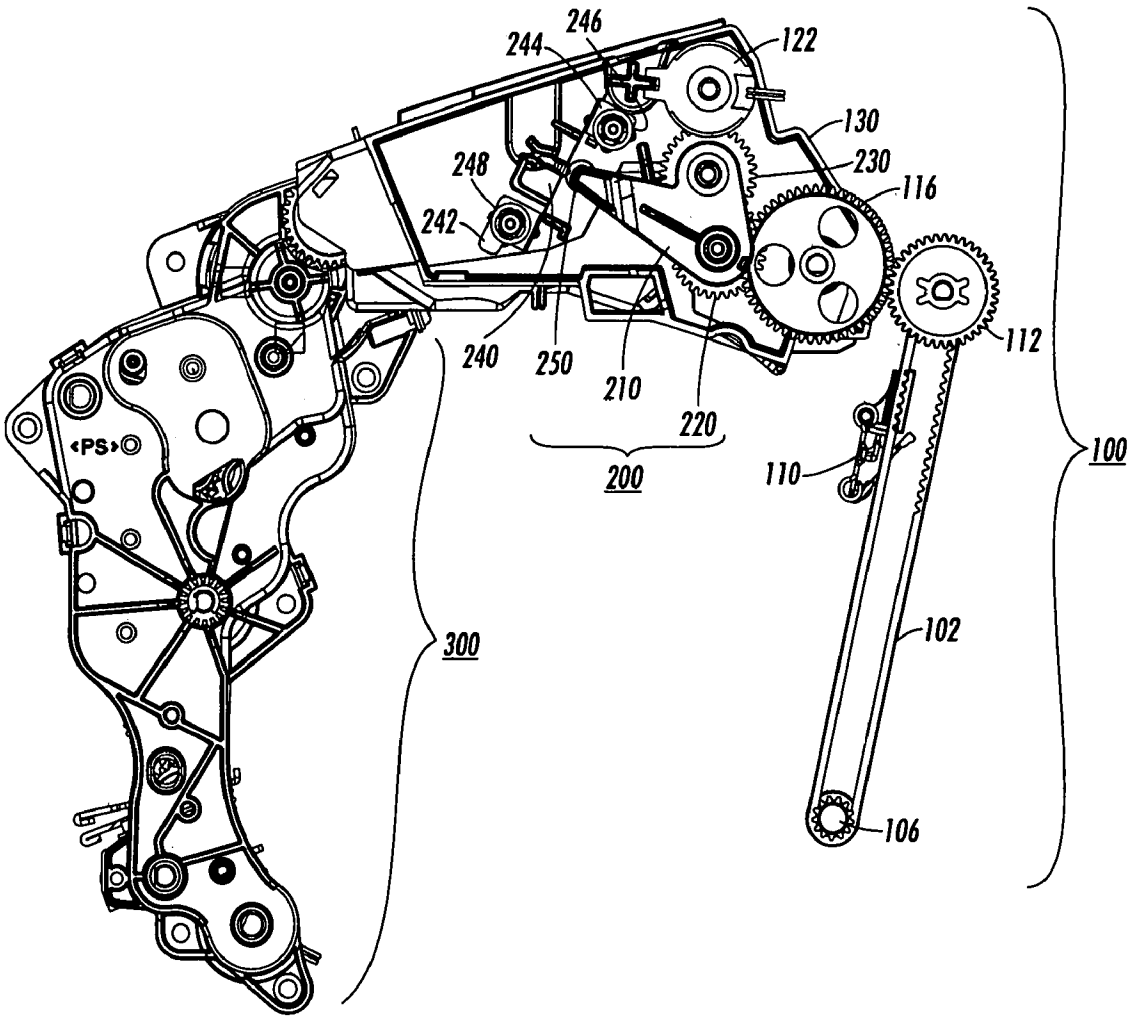
FIG. 3 shows a side view showing in detail of the locking mechanism according to an exemplary embodiment of this invention.

In FIGS. 2 and 3, several views of the exemplary wiper drive system 100 are shown. As shown in FIGS. 2 and 3, a wiper drive system 100 employs a wiper 110 used to clean the surface of a printer/copier head such as that shown in FIGS. 1A–1D. The wiper drive system 100 further includes a drive motor assembly 300 that rotationally drives the exit shaft 124 connected to the clutch 122. Disposed between the mechanisms 102–120 that drives the wiper 110, and the drive motor assembly 300, is a lock mechanism 200 that locks the movement of the wiper 110 and its associated mechanism 102–120. When engaged, the clutch 122 will allow the rotational drive from the drive motor assembly 300 to be transferred through the lock mechanism 200 to the idle gear 116 and to drive the wiper 110. When locked, the lock mechanism 200 stops the above transfer of the rotational drive from the assembly 300 through the lock mechanism 200 to the idle gear 116 even when the clutch 122 is engaged. Additionally, when locked, the lock mechanism 200 will lessen or prevent substantial movement of the wiper 110 and its mechanism 102–120 even when the clutch 122 is not engaged.

As shown in detail in FIGS. 2 and 3, the wiper 110 is connected to, and is driven by, a pair of belts 102, 104. Each of the belts 102, 104 is extended by tension between two rollers, i.e., pulleys 105 and 106 that create the tension for belt 102, and pulleys 107 and 108 that create the tension for belt 104. Each of the pulleys 106, 108 are rotated at least substantially synchronously. The corresponding pulleys 105, 107 are connected to rotating members 112, 114, respectively and are co-rotating. Each of the rotating members 112, 114 are respectively in rotational communication with rotating members (idle gears) 116, 118. The rotating members 112, 114 are shown as gears (drive gears) in the exemplary embodiment. The idle gears 116, 118 are connected by an alignment/timing rod 120, and are co-rotating. A driving rotation which rotates either of the idle gears 116, 118 will cause the other of the idle gears 116, 118 to co-rotate through the alignment/timing rod 120 and cause rotation of their respective rotating members 112, 114; pulleys 105, 107; belts 102, 104; and pulleys 106, 108, assuring a level movement of the wiper 110. The driving rotation may be applied to either idle gears 116, or 118, or both. In the exemplary embodiment shown in FIGS. 2 and 3, the driving rotation is applied to the idle gear 116.

As shown in the exemplary embodiment of FIGS. 2 and 3, the wiper 110 is generally long and narrow and is adapted to clean the surface of the printhead of any accumulated debris or hardened ink. The wiper 110 is generally moved across the printhead (not shown in FIGS. 2 and 3) during operation, contacting and cleaning the surface of the printhead in a wiping motion. The wiper 110, as shown in FIGS. 2 and 3, may be moved vertically generally from the bottom to the top or vice versa. In this exemplary embodiment, the traversing movement of the wiper 110 across the printhead is enabled by simultaneous movement of the pair of belts 102, 104. Each opposing ends of the wiper 110 is attached to the respective belts 102, 104 at a predetermined portion of the belt 102, 104. The wiper 110 is attached to the belts 102, 104 so that the wiper 110 is substantially level during operation.

The attachment of the wiper 110 to the belts 102, 104 may be by any driver currently available or later developed. The belts 102, 104 may be smooth or may have teeth. The movement of the wiper 110 may be by any other driver currently available or later developed as long as level movement of the wiper 110 is assured, and the driver need not comprise two belts, but can also be a single or a plurality of belts. In fact, any later developed system for movement of the wiper may be used.

The driving rotation for the mechanism 100, including the wiper components 102–120 comes from the drive motor assembly 300. The drive motor assembly 300 includes various rotational speed governing speed gears 310–316 as well as gears for driving other portions of the copier/printer apparatus such as a gear 320. In the exemplary embodiment shown in FIGS. 2 and 3, the drive motor assembly 300 rotationally drives the exit shaft 124 connected to the clutch 122. When engaged, the clutch 122 will transfer the rotational drive from the assembly 300 through the lock mechanism 200 to the idle gear 116.

In FIG. 3, which is a side view of the assembly 100 of FIG. 2, shows the rotational relationship of the components in the wiper drive system 100 between the drive motor assembly 300 and the pulley 106. As shown in FIG. 3, the belt 102, to which the wiper 110 is attached, is extended between the pulley 106 and the drive gear 112. The drive gear 112 is in rotational communication with the idle gear 116 which is in rotational communication with the lock mechanism 200. The lock mechanism 200 is in rotational communication with the clutch 122 which, as shown in FIG. 2, is in rotational communication with the drive motor assembly 300. FIG. 3 further shows a base 130 to which the idle gear 116, the clutch 122 and the many components of the lock mechanism 200 is attached.

Figure 4:
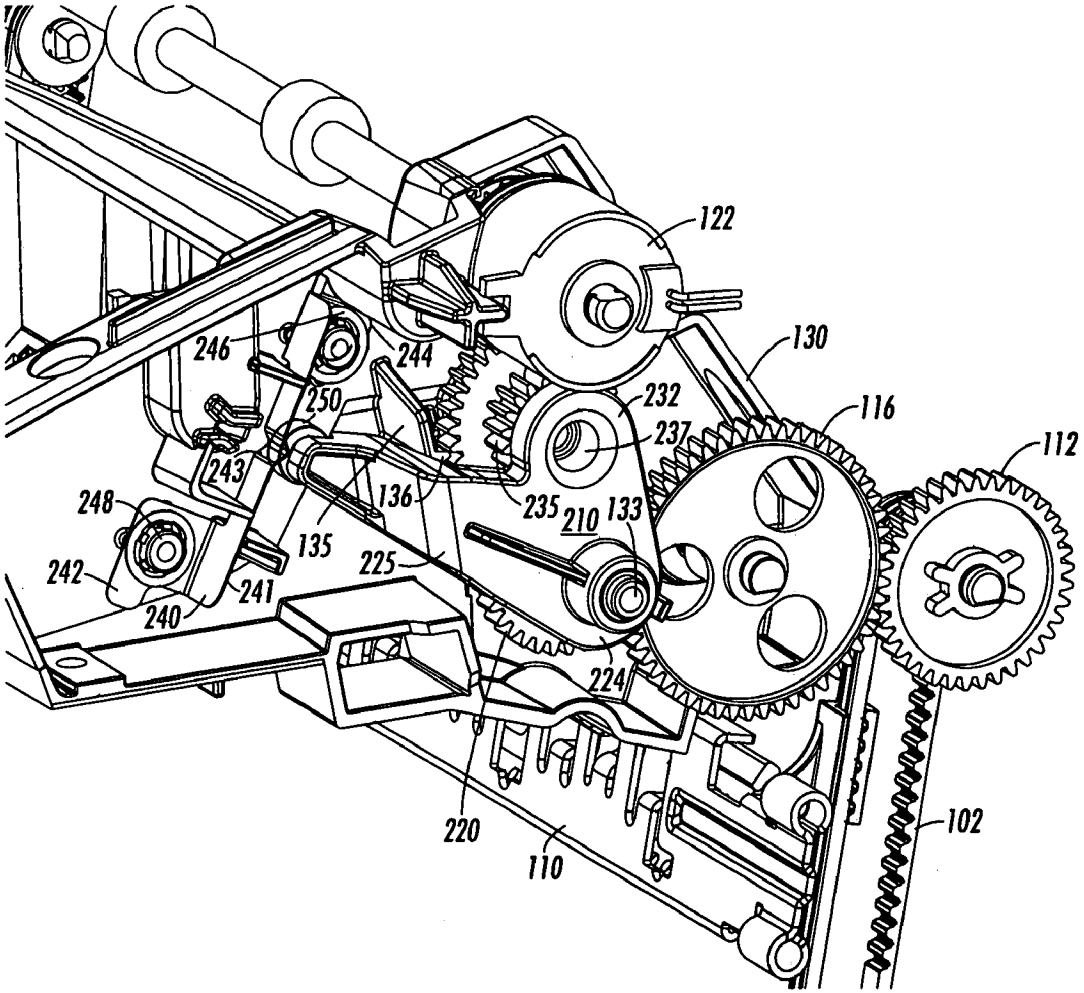
FIG. 4 discloses in detail of the lock mechanism according to an exemplary embodiment of this invention.

As shown in further detail in FIG. 4, the lock mechanism 200 includes a support member 210 that includes a first rotating member assembly (pivot gear assembly) 220, a second rotating member assembly (locking gear assembly) 230, and a third rotating member (roller) 250. The lock mechanism 200 also includes a biasing member (spring) 240 that is formed on, or attached to the base 130. The lock mechanism 200 also includes a protruding portion 135 that is formed on, or attached to the base 130 with a tooth 136 protruding from the protruding portion 135.

Figure 5:
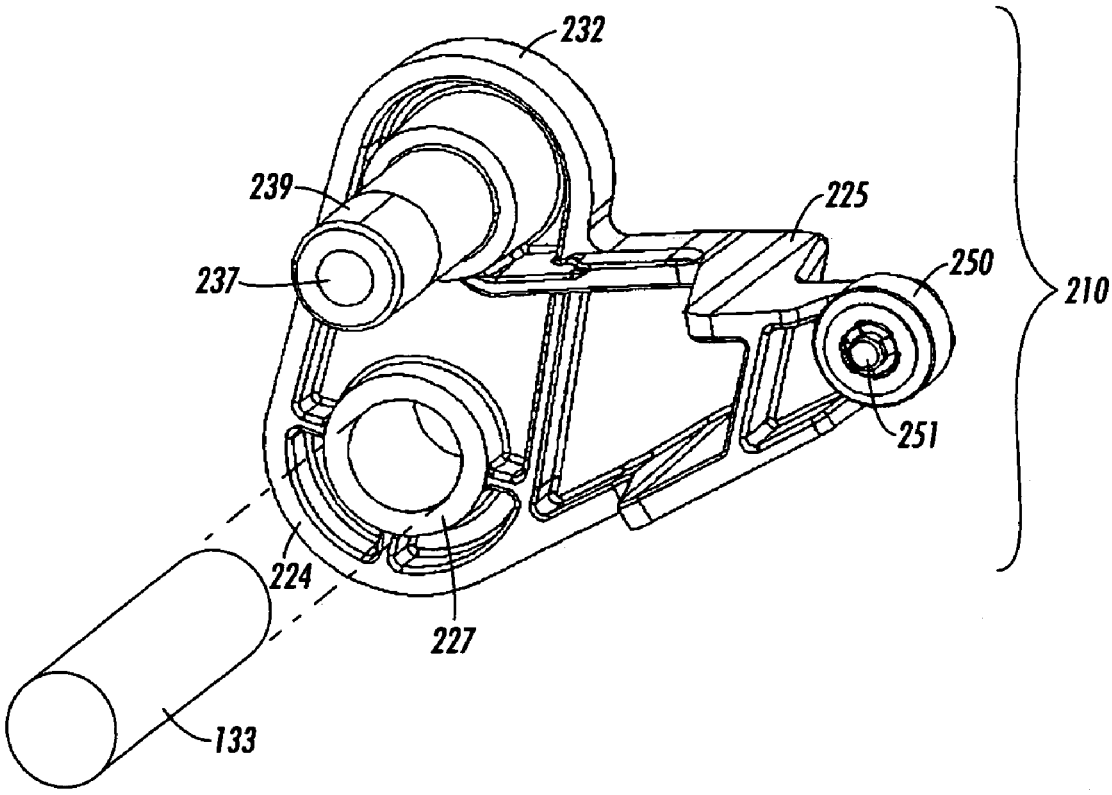
FIG. 5 is a view showing in detail the support member for the lock mechanism according to an exemplary embodiment of this invention.
Figure 6A:
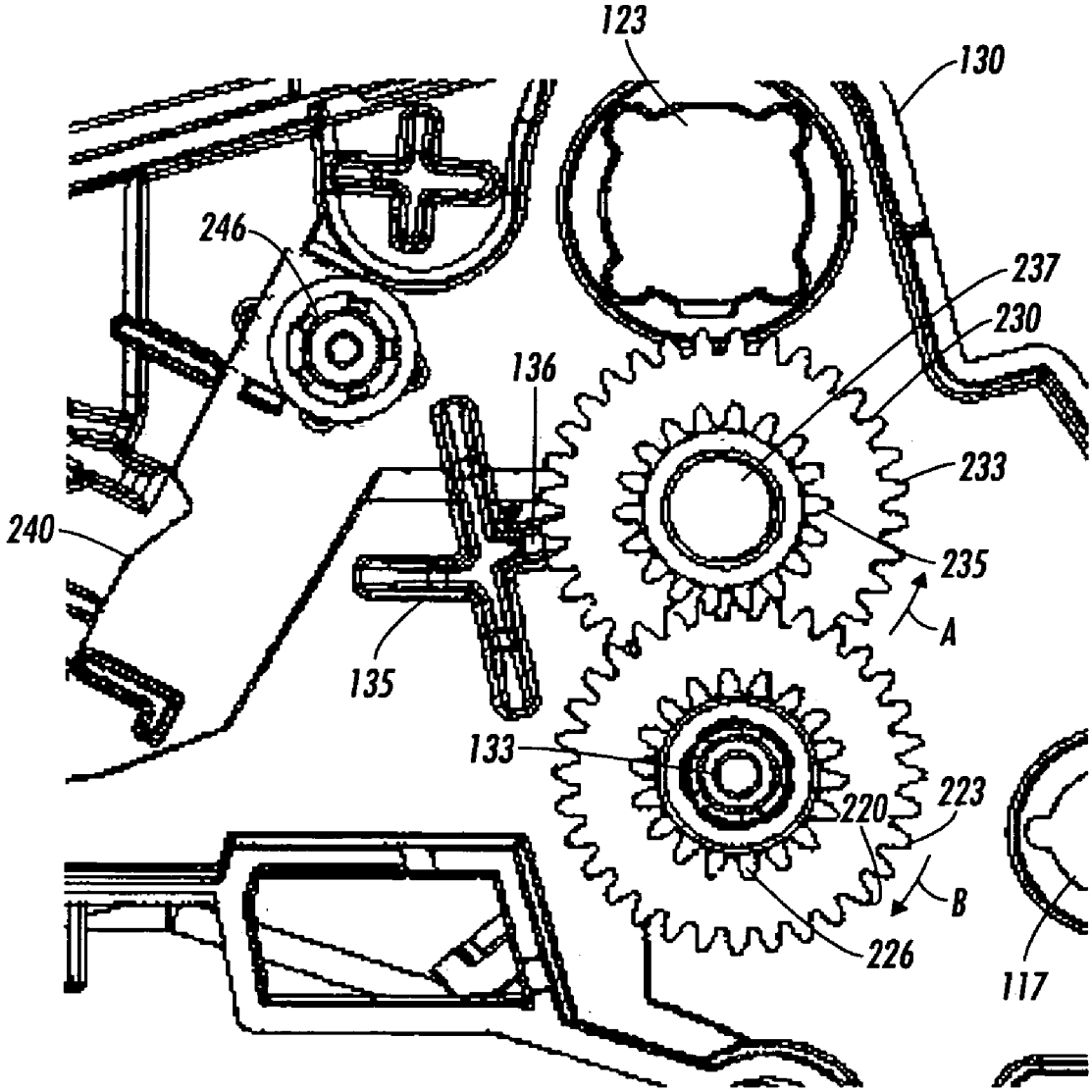
FIGS. 6A and 6B shows in detail the locking of the lock mechanism according to an exemplary embodiment of this invention.
Figure 6B:
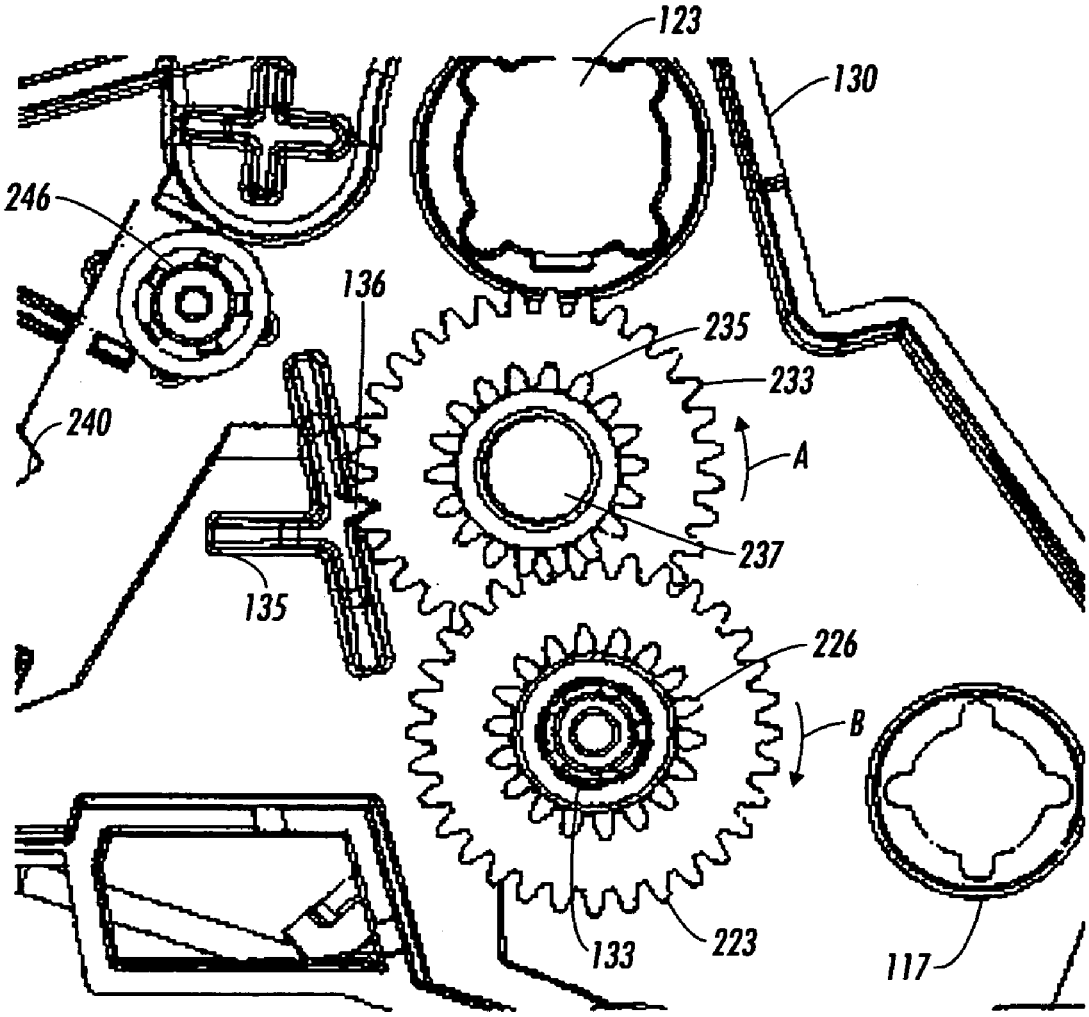

As shown in FIG. 4, the support member 210 holds the pivot gear assembly 220, the locking gear assembly 230, and the roller 250. FIGS. 5, 6A and 6B show a detailed view of an exemplary embodiment of the support member 210, and its gear mechanisms and rollers. FIG. 5 is an opposite side view of the support member 210 from that of FIG. 4. FIGS. 6A and 6B show a detailed view of the gear mechanisms 220, 230 and their operations. FIGS. 6A and 6B are exploded views of FIG. 3 and show only the pivot gear assembly 220 and the locking gear assembly 230 for clarity.

As shown in FIGS. 4 and 5, the support member 210 is generally triangularly shaped with each of the pivot gear assembly 220, locking gear assembly 230, and roller 250 located in portions generally forming an apex of the triangularly shaped support member 210. That is, the support member 210 holds the pivot gear assembly 220, the locking gear assembly 230, and the roller 250 at the triangularly shaped apex-like portions 224, 232, and 225, respectively. The apex-like portion 225 is more pronounced that the other apex-like portions 224, 232 whereby the apex-like portion 225 is more like an arm in the support member 210 and extends further from a center of the apex-like portions than other two apex-like portions 224, 232. As shown in the exemplary embodiment of FIG. 5, the support member 210 includes a hole 227 that is formed in the apex-like portion 224 containing a shaft 133; a locking gear shaft 239 extending in the apex-like portion 232; and an arm 225 holding the roller 250.

However, the support member 210 may be other shapes or arrangements. For example, the support member 210 may be circular, oval, rectangular, square, chevron-like, or any other shape. The support member 210 may be any shape that assures sufficient number of gear assemblies, and at least one, can be formed on the support member 210. The support member 210 may be any thickness, or combination of thicknesses, and may be a thin strip. The support member 210 can be any shape or configuration that allows one end of the support member to pivot about another end when structures such as the gear assemblies are formed on the support member. The support member 210 may be a solid piece of material reinforced with ridges as shown in FIG. 5, or a frame with perforations in portions that are not needed for structural support of the support member 210.

Both the pivot gear assembly 220 and the locking gear assembly 230 include a large and small gear that are coaxial and co-rotational. In the exemplary embodiment shown in FIGS. 4, 6A and 6B, the locking gear assembly 230 has a large gear 233 and a small gear 235, and the pivot gear assembly 220 includes a large gear 223 and a small gear 226. The roller 250 rotates about the shaft 251.

The pivot gear assembly 220, including a large gear 223 and a small gear 226, is rotationally supported on the shaft 133 that extends through the hole 227. The shaft 133 is attached to or integral with the base 130. Thus, the support member 210 is attached to the base 130 via the shaft 133 that is associated with the base 130. On the other hand, the locking gear assembly 230, including its large gear 233 and small gear 235, is rotationally attached to the locking gear shaft 239 that is attached to or integral with the support member 210. As a result, the shaft 133 forms the axle for the pivot gear assembly 220, and further allows the entire support member 210 to rotate about the shaft 133. Consequently, the locking gear assembly 230, attached to end of the arm 225 is also allowed to rotate about the shaft 133, resulting in allowing the locking gear shaft 239 and the shaft 251, while attached to the support member 210, to rotate about the shaft 133.

Further, as shown in the exemplary embodiment of FIGS. 6A and 6B, and as previously discussed, the pivot gear assembly 220 includes the large gear 223 and a coaxial and co-rotating small gear 226. The locking gear assembly 230 includes the large gear 233, and its coaxial, co-rotational small gear 235. For the locking gear assembly 230, large gear 233 is in rotational communication with the gear on the clutch 122 while the small coaxial gear 235 is in rotational communication with the large coaxial gear 223 of the pivot gear assembly 220. In turn, the small gear 226 of the pivot gear assembly 220 is in rotational communication with the idle gear 116 located on the perforation 117. Therefore, when the clutch 122 is engaged during operation, the gear on the clutch 122 rotates the large gear 233 of the locking gear assembly 230, which rotates the small gear 235. The small gear 235 of the locking gear assembly 230 rotates the large gear 223 of the pivot gear assembly 220, which rotates the small gear 226. The small gear 226 of the pivot gear assembly then rotates the idle gear 116. In this way, the rotational drive of the device is transferred from the drive motor assembly 300 to the wiper 110 through the lock mechanism 200.

Figure 7A:
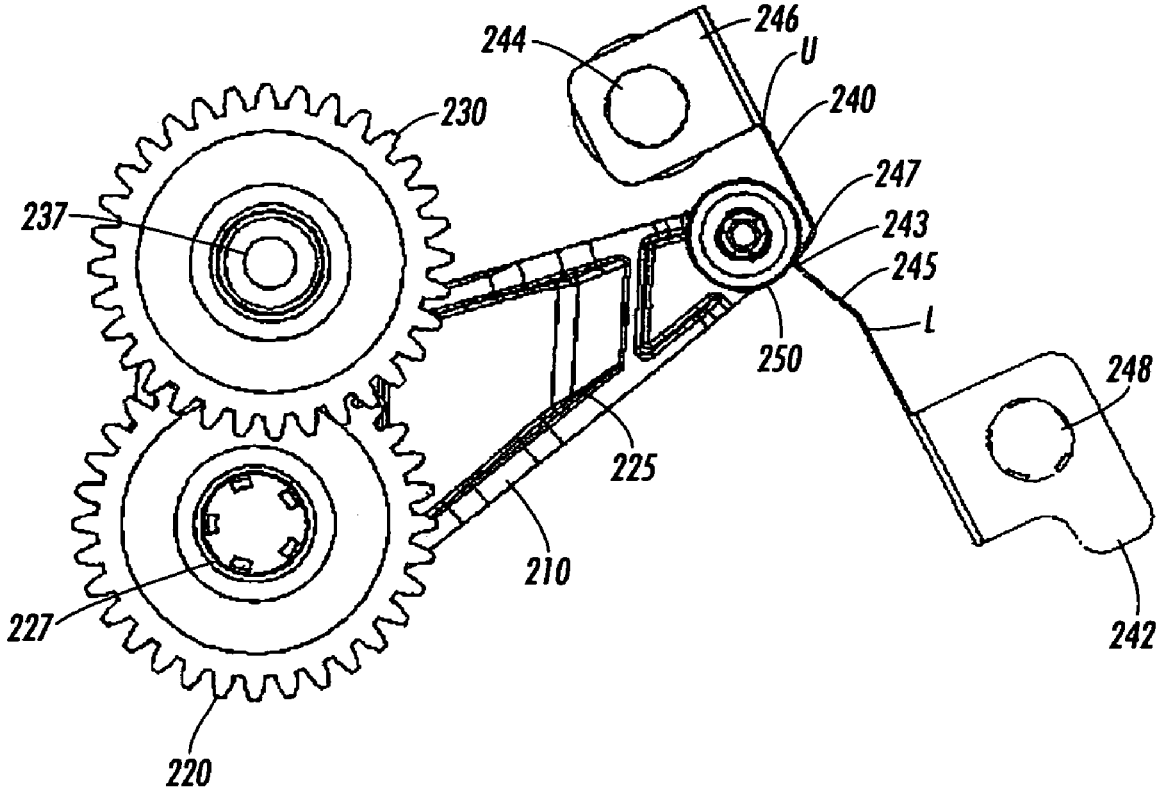
FIGS. 7A and 7B shows in detail a rotating member in a biasing spring according to an exemplary embodiment of this invention.
Figure 7B:
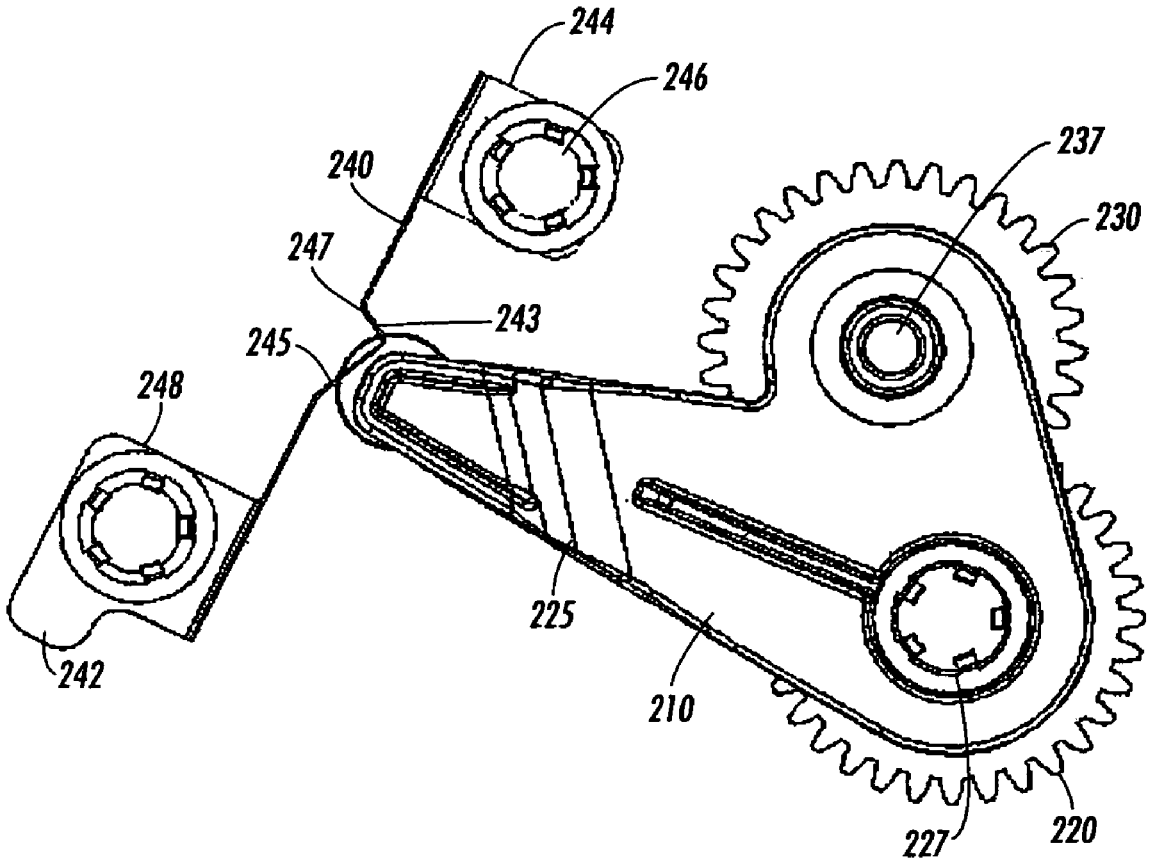

As shown in the exemplary embodiment of FIG. 4, the spring 240 is formed on, or attached to the base 130. The spring 240 includes a flat portion 241, flaps or flap portions 242, 244, a differential slope 243 which, along with the flat portion 241, constitutes the biasing portion of the spring 240. As shown in FIGS. 4 and 7A, 7B, the differential slope 243 includes a moderate incline 245 and a steep incline 247. The differential slope 243 divides the spring 240 into two regions U, the unlocked region, and L, the locked region. The flaps 242, 244 of the spring 240 are used to attach the spring 240 to the base 130 through the attachments 246, 248. Of course, the spring 240 may be integrally formed with the base.

As shown in the exemplary embodiment of FIG. 4, the roller 250 contacts the spring 240 such that the differential slope 243 is placed towards the roller 250. Because the differential slope 243 divides the spring 240 into two regions U, L, the roller 250 is received in either of the two regions, as shown in FIGS. 7A and 7B. In the exemplary embodiment shown in FIG. 4, the roller 250 is attached to the apex-like portion 225 at an extreme end. The placement of the roller 250 at the end of portion 225 is sufficient to place the outer edge of the roller to at least contact the differential slope 243 of the spring 240.

Further, as shown in FIGS. 3 and 4, the protruding portion 135 is formed on, or attached to, the base 130. The protruding portion 135 includes a tooth 136 which engages the large gear 233 of the locking gear assembly 230. The tooth 136 is generally wedge-shaped to be inserted into the gaps in between the gear teeth of the large gear 233 of the locking gear assembly 230 in this exemplary embodiment. However, the tooth 136 may be formed to be inserted into other gears. There may be a plurality of teeth 136 that work in conjunction to be inserted into several gaps in the gears. The tooth may be other devices that stops the rotation of any of the gears 223, 226, 233, 235, or any other part of the lock mechanism 200. Therefore, the protruding portion 135 with the tooth 136, and the spring 240 are parts of the lock mechanism 200.

The operation of the lock mechanism 200 will be discussed using the exemplary embodiment of FIGS. 6A and 6B. As shown in FIG. 6A, when the clutch 122 is engaged, a rotational drive from the drive motor assembly 300 (FIGS. 2 and 3) is transferred to the gears, in the forward direction, to the lock mechanism 200 and a rotation of the locking gear assembly 230 is achieved (arrow A). The rotation of the locking gear assembly 230 in the A direction causes a corresponding rotation of the pivot gear assembly 220 in the direction B (arrow B). The rotation of the pivot gear assembly 220 is then transferred to the idle gear 116. Thereby, the rotation of the drive motor assembly 300 is sent through the lock mechanism 200 to the drive gears 112, 114 which drive the belts 102, 104, raising the wiper 110 substantially level.

The forward rotation of the gear assemblies 220, 230 continues until the wiper 110 reaches an extreme position of travel as shown in FIG. 1D, and the wiper 110 is stopped from rising further. The stopping of the wiper 110 near the upper end of the belts 102, 104, and near the drive gears 112, 114, creates a chain reaction that causes each gear in the chain from components 102–118 to almost instantaneously stop rotating because the wiper 110 can not be moved longer by the components 102–118.

When the rotation of all the components 102–118 stops, the rotation of the pivot gear assembly 220 also stops. However, the locking gear assembly 230 momentarily continues to rotate because those gears in the locking gear assembly 230 continue to be driven in the forward direction A by the rotation of the gear 233 by the clutch 122. That is, the pivot gear assembly 220 acts as a sun gear while the locking gear assembly 230 acts as a planetary gear. Thus, because the rotation of the pivot gear assembly 220 in direction B is stopped, the gears in the locking gear assembly 230, i.e., small gear 235, travel over the gear teeth on the periphery of the stopped large gear 223 of the pivot gear assembly 220. The travel of the small gear 235 over the periphery of the large gear 223 causes the locking gear assembly 230, and the entire support member 210 to which it is attached, to rotate about the shaft 133, to approach the tooth 136 formed on the tooth holder 135. Thereafter, the tooth 136 becomes wedged between two of the gear teeth on the large gear 233. Upon intimate engagement of tooth 136 with the immovable teeth in the large gear 233, the locking gear assembly 230 is also stopped from further rotating. Therefore, any further rotation of all the gears down the chain is stopped and the locking gear becomes held as shown in FIG. 6B.

FIGS. 7A and 7B show the interaction between the support member 210 and the spring 240, which occurs simultaneously with the interaction of the pivot gear assembly 220 and the locking gear assembly 230 discussed above, wherein FIG. 7A illustrates the support member 210 and their spring 240 in the unlocked (first position) during normal operation, and FIG. 7B illustrates the support member 210 and their spring 240 in a locked position (second). As shown in FIG. 7A, in the unlocked or first position, both the pivot gear assembly 220 and the locking gear assembly 230 on the support member 210 are rotated and transferring the rotational drive from the drive motor assembly 300 to the wiper 110. In other words, the pivot gear assembly 220 and the locking gear assembly 230 are in the position as shown in FIG. 6A. The locking gear assembly 230 is able to be rotated as long as the wiper 110 is not at an extreme position of travel, e.g., in the vertical-most position near the drive gears 112, 114 abutting a hard stop portion (as in FIG. 1D). The lock mechanism 200 is assured to be in the unlocked position without unintentionally locking by a differential slope 243 forming a steeper incline 247 than the moderate incline 245 whereby a greater torque about the shaft 133 is required to pivot the arm 225 to move the roller from the first position U to the second position L over the steep incline 247.

As shown in FIG. 7A, while the roller 250 is in the unlocked position U, the locking gear assembly 230 and the pivot gear assembly 220 are able to be rotated, and the roller 250 is nested in the unlocked position U. In the unlocked position U, the spring 240 does not apply a biasing spring force to the roller 250, and the roller 250 is not in continuous contact with the spring 240. Further, the roller 250 will tend to remain in the unlocked position because of the steep incline 247, which is steeper than the moderate incline 245, tends to stop the roller 250 from traversing the steep incline 247 without a sufficient rotational force. That is, in order to move the roller 250 over the steep incline 247 from the unlock position U into the lock position L, sufficient rotational force must be applied to the support member 210 to rotate the support member 210 about the shaft 133. Such sufficient rotational force is from the forward drive of the drive mechanism 300.

Given sufficient rotational force applied during movement of the support member 210 from the unlocked position U to the locked position L, the roller 250 will roll over the steep incline 247. The movement of the support member 210 from position U to position L is also aided by the rotation of the roller 250. The roller 250 allows the support member 210 to move over the moderate incline 245 of the spring 240. Without the roller 250, friction between the support member 210 and the spring 240 would tend to resist movement of the support member 210 over the moderate incline 245 on the spring 240. Therefore, the rotational force needed to rotate the support member 210 about shaft 133 may be reduced by inclusion of the roller 250.

On the other hand, as shown in FIG. 7B, once the support member 210 is pivoted about shaft 133 and the roller 250 is moved from the unlocked position U to the locked position L, the locking gear assembly 230 and the pivot gear assembly 220 are stopped from rotating, and the roller 250 is nested in the locked position L. In the locked position L, the spring 240 always contact the roller 250 and a force from the spring 240 is acted on the roller 250. Thus, in the locked position L, the roller 250 does not freely rotate because the roller 250 is almost in constant contact with the spring 240. In other words, in the locked position L, there is substantially no play between the roller 250 and the spring 240.

The spring force acting on the roller 250 from the spring 240 tends to preload energy into the system such that rotational force (or torque) needed to move the roller 250 from the locked position L to the unlocked position U is less than the rotational force needed to move the roller 250 from the unlocked position U to the locked position L. Further, the moderate incline 245 allows the roller 250 to more easily move over the differential slope 243 from the locked position L to the unlocked position U than the reverse case of the steep incline 247. Thus, using the spring 240 and differing inclines 245, 247, the force needed to lock and unlock the lock mechanism 200 is controlled.

Figure 8:
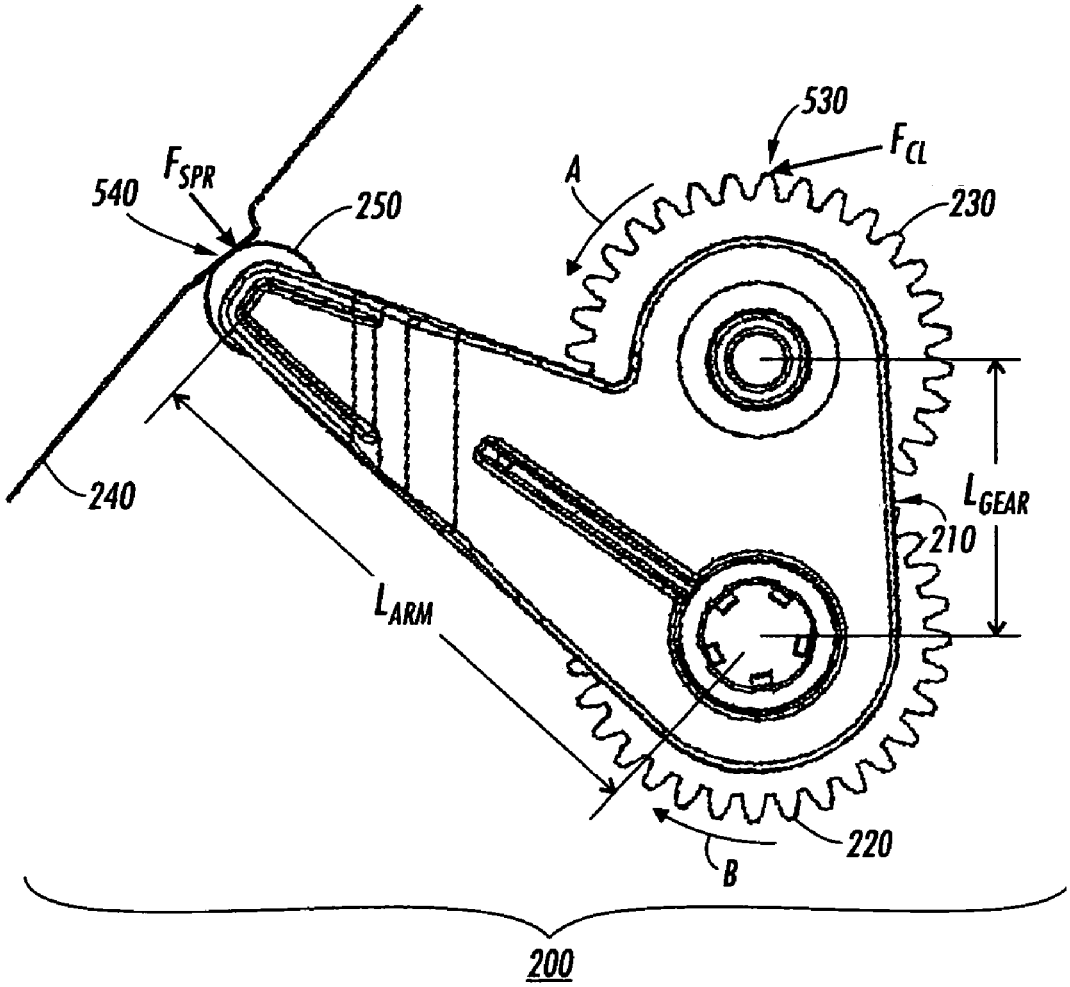
FIG. 8 is a force diagram showing loading of the lock mechanism prior to unlocking.

FIG. 8 shows a schematic of the forces that act on the lock mechanism 200, while the it is locked whereby the lock mechanism 200 is further driven in the forward direction (A in FIGS. 6A and 6B) to first load the lock mechanism 200 and the system to which it is a part, to store energy. The stored energy is later released and a resultant recoil of the lock mechanism 200 and the system is used to unlock the lock mechanism 200. As the wiper 110 reaches an extreme position of travel and the stoppage is transmitted down the chain of gears, the forces acting on the lock mechanism 200 are as shown in FIG. 8. These forces include a clutch force Fcl 530 and a spring force Fspr 540. The clutch 122 applies clutch force Fcl 530 to the locking gear assembly 230 and attempts to further rotate the locking gear assembly 230. At the same time, because the lock 200 is in the locked position, the spring 240 applies the Fspr 540 to the roller 250.

As shown in FIG. 8, the pivot gear assembly 220 is attempting to turn in a clockwise (B) direction in reaction to a clutch force Fcl 530 being transmitted from the clutch 122 acting on locking gear assembly 230 to turn the locking gear assembly 230 in a counterclockwise (A) direction. However, the locking gear assembly 230 cannot rotate because of its engagement with the tooth 136 as in FIG. 6B. Instead of causing the locking gear assembly 230 to rotate, the force 530 simply loads the lock mechanism 200, and increases the stored energy of the system. The applied load will tend to bend at least the support member 210.

Once sufficient force or energy is applied or loaded into the system, and prior to any permanent bending or breaking of any components occurs, the forward loading is ceased by disengagement of the clutch 122 with the locking gear assembly 230 or reversal of the clutch 122 and the clutch force Fcl 530. Almost instantaneously, the energy loaded onto the system will be released, and cause a rebound or recoil to allow locking gear assembly 230 to disengage with tooth 136, and also allow the roller 250 to pivot from the locked position L to the unlocked position U. With the help of force of the spring 240, the lock mechanism 200 takes advantage of elasticities in the components with the existing drive system to first load the system, and thereby store energy, and then quickly release the load, and the stored energy, to use the resultant recoil to quickly and efficiently release the lock, and move the lock mechanism 200 from the locked to the unlocked position.

Figure 9:
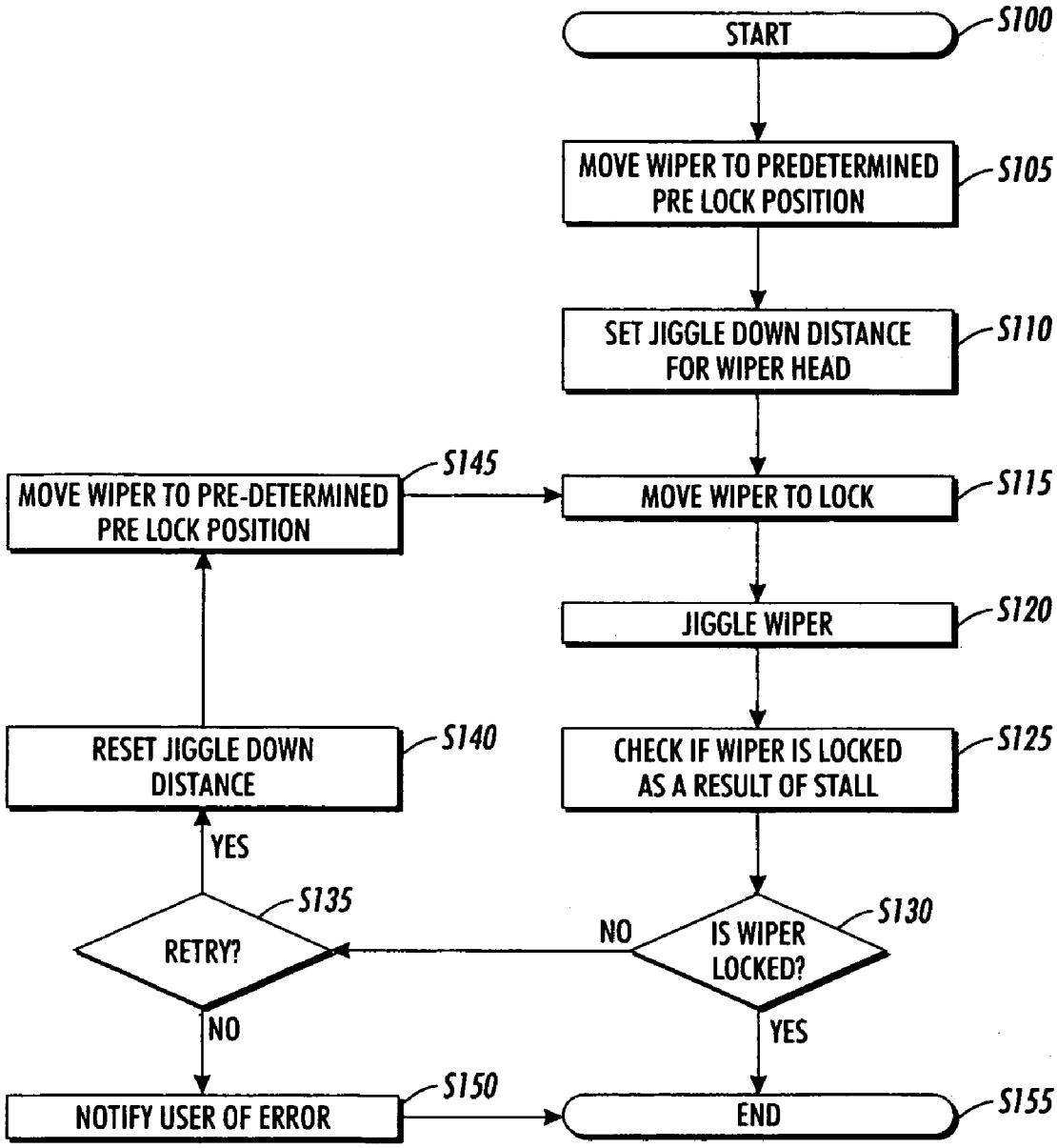
FIG. 9 is a diagram illustrating an exemplary method of locking the lock mechanism according to an exemplary embodiment of this invention.

FIG. 9 is a flowchart illustrating an exemplary method of locking the lock mechanism according to an exemplary embodiment of this invention. Beginning in step S100, the operation proceeds to step S105 where a wiper is moved to a predetermined, pre-lock position. Thereafter, in step S110, a jiggle down distance for the wiper is set. In this exemplary embodiment, the jiggle down distance is the distance for which the wiper is allowed to move down because the locking gear assembly did not properly engage the tooth, or is held by the tooth. Then in step S115, the wiper is moved from the pre-lock position to a lock position when the wiper is at an extreme position of travel.

In step S120, the wiper is jiggled (i.e. attempted to move along the jiggle down distance) to ensure the wiper is locked because the locking gear properly engages the tooth and the roller is moved from the unlocked position to the locked position. Then in step S125, it is checked whether the wiper is locked by checking if the wiper is held, or if the wiper is still able to move freely. The operation then continues to step S130, where it is confirmed if the wiper is locked because it is unable to move. If locked, the operation ends in step S155. Otherwise, the operation continues to step S135 where it is determined whether to retry the locking maneuver.

If the operation maneuver is reattempted, the operation continues to step S140 where the jiggle down distance is reset which may be less than the previous jiggle down distance of step S110. The operation then continues to step S145 where the wiper is again moved to a predetermined pre-lock position which may be the same or different as in step S105. However, in step S135, if it is determined not to retry the locking maneuver, such as when sufficient attempts have already been made, a user is notified of the error in step S150. The operation then ends in step S155.

It should be appreciated that, in step S105, in various exemplary embodiments, the wiper, such as wiper 110, is moved to a predetermined, pre-lock position such as the resting position of FIG. 1. It should be appreciated that, in step S110, in various exemplary embodiments, the jiggle down distance is the distance for which the wiper 110 is allowed to move down while attached to the belts 102, 104, if the lock mechanism 200 is not locked because the locking gear assembly 230 did not properly engage the tooth 136 and the roller 250 is not in the locked position. It should be appreciated that, in step S115, in various exemplary embodiments, the wiper, such as wiper 110 wiper is moved from the pre-lock position to a lock position when the wiper 110 is at an extreme position of travel.

It should be appreciated that, in step S120, in various exemplary embodiments, the wiper 110 is jiggled to eliminate any play, and is also driven such that if the lock mechanism 200 is not locked, then the wiper 110 travels the pre-set jiggle down distance away from the lock position, which is the extreme position of travel near the rotating members 112, 118. On the other hand, if the lock mechanism 200 is locked, the wiper 110 does not travel, and the fact the wiper 110 is not moved is checked in step S125.

It should be appreciated that, in step S130, in various exemplary embodiments, it is confirmed whether the lock mechanism 200, and by extension the wiper 110, is locked. The wiper 110 is locked if the wiper stalls and does not travel the jiggle down distance in step S125.

Figure 10:
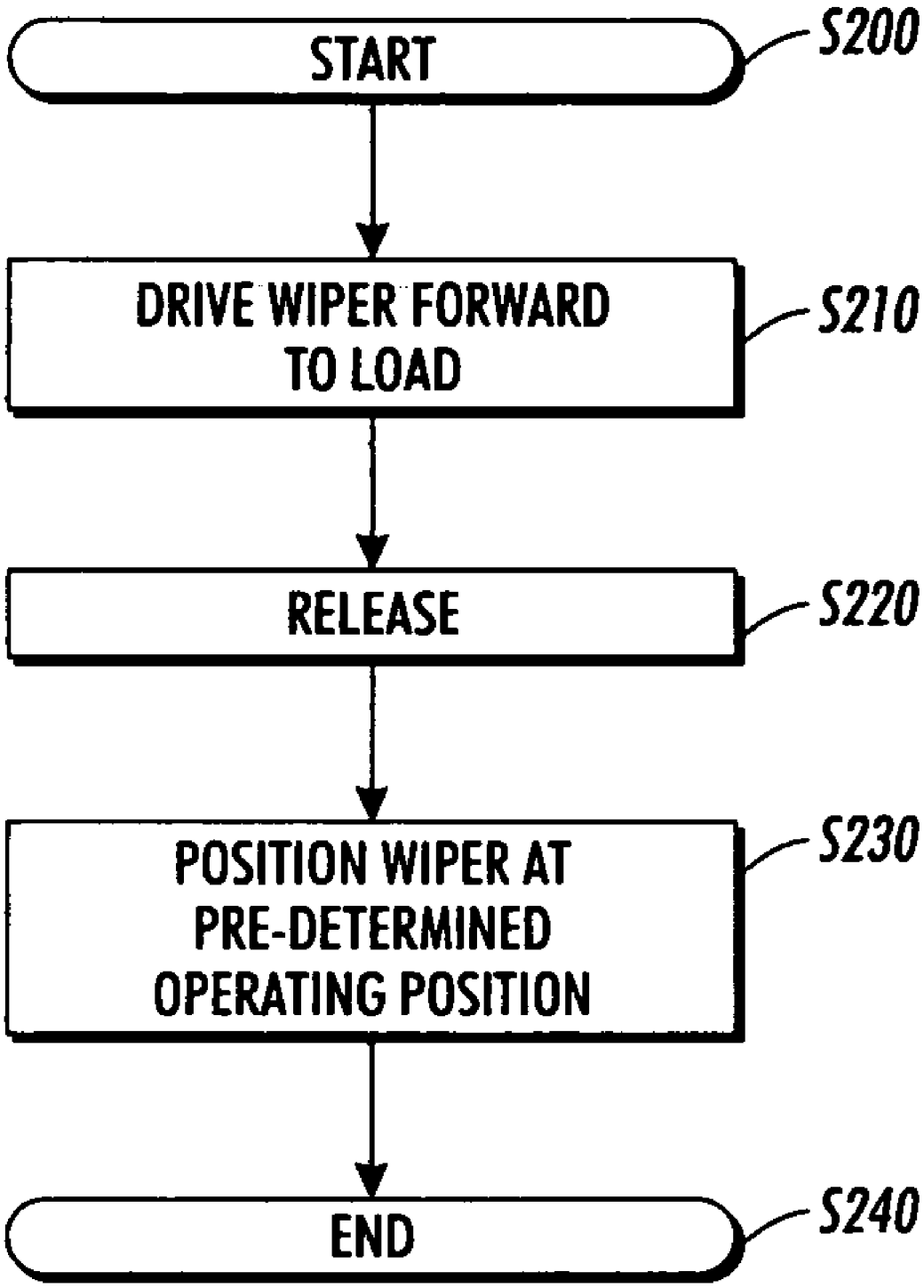
FIG. 10 is a diagram illustrating an exemplary method of unlocking the lock mechanism according to an exemplary embodiment of this invention.

FIG. 10 is a diagram illustrating an exemplary method of unlocking the lock mechanism according to an exemplary embodiment of this invention. Beginning with step S200, the operation continues to step S210 where the wiper is driven forward to load energy into the lock mechanism. Thereafter, in step S220, the forward drive is stopped or reversed so that the stored energy in the lock mechanism is released, and the lock mechanism disengages itself from the locked position, and moves to an unlocked position. Once the lock mechanism is unlocked, the wiper is moved to a predetermined, operating position. The operation then ends in step S240.

It should be appreciated that, in step S210, in various exemplary embodiments, the wiper drive mechanism 100 (of FIG. 2, for example) may be driven forward to load the lock 200 to store energy. It should be appreciated that, in step S220, in various exemplary embodiments, it may be the clutch 122 which is reversed or released (which effectively stops the forward drive) so that the stored energy in the lock mechanism 200 recoils and allows the locking gear assembly 230 and the tooth 136 to disengage and release itself when the support member 210 pivots about the shaft 133 in the opposite direction of rotation as the direction of rotation for locking. Simultaneously, the rotation of the support member 210 causes the roller 250 to move from a second locked position L to a first unlocked position U.

It should be appreciated that, in step S230, in various exemplary embodiments, the wiper 110, which is now free to move because the lock mechanism 200 is unlocked, is positioned at a predetermined operating position, which may be the resting position shown in FIG. 1.

While this invention has been described in conjunction with various exemplary embodiments, it is to be understood that many alternatives, modifications and variations would be apparent to those skilled in the art. Accordingly, the exemplary embodiments of this invention as set forth above, are intended to be illustrative, and not limiting.

What is claimed is:

1. A locking mechanism for use in an image processing device with at least one driving element for driving a movable element, comprising a support member disposed between the driving element and the movable element, the support member being movable between a first position and a second position;

a pivot on the support member about which the support member is able to rotate; and a first rotating member on the support member, the first rotating member rotating when the movable element is moved by the driving element, wherein the locking mechanism is locked when both the first rotating member is stopped from rotating and the support member is rotated from the first position to the second position about the pivot.

2. The locking mechanism of claim 1, further comprising a second rotating member attached to the pivot, the second rotating member being in direct rotational communication with the first rotating member.

3. The locking mechanism of claim 2, wherein the first rotating member is stopped from rotating by engaging a protruding portion separate from the support member.

4. The locking mechanism of claim 3, wherein the protruding portion comprising a gear tooth.

5. The locking mechanism of claim 4, wherein the first rotating member and the second rotating member each comprise a large rotating member and a small rotating member, the corresponding large and small rotating member being coaxial.

6. The locking mechanism of claim 5, wherein the small rotating member of the first rotating member is in direct rotational communication with the large rotating member of the second rotating member.

7. The locking mechanism of claim 6, wherein the large and small rotating members of the first rotating member and the second rotating member comprise gears.

8. The locking mechanism of claim 7, wherein the support member further comprises a third rotating member on the support arranged to engage a biasing member separate from the support member.

9. The locking mechanism of claim 8, wherein an annular surface of the third rotational member is smooth.

10. The locking mechanism of claim 9, wherein the biasing member comprises a spring having a substantially flat surface opposing the annular surface of the third rotating member so that the third rotating member rolls over the substantially flat surface.

11. The locking mechanism of claim 10, wherein the biasing member includes an asymmetrical differential slope in a portion of the flat surface, such that the portion extends toward the third rotating member.

12. The locking mechanism of claim 11, wherein the sloped portion defines the first position on one side and the second position on the other side.

13. The locking mechanism of claim 12, wherein the biasing member applies a greater force to the third rotating member when the support member is in the second position than in the first position.

14. The locking mechanism of claim 13, wherein the support member is generally triangular in shape having at least three apex-like portions, the first rotating member being rotatably mounted at a first apex-like portion, and the second rotating member being rotatably mounted at a second apex-like portion.

15. The locking mechanism of claim 14, wherein a third apex-like portion extends further from a center of the apex-like portions than the first and second apex-like portions.

16. The locking mechanism of claim 15, wherein the third rotating member is rotatably mounted on the third apex-like portion.

17. A method for locking a locking mechanism in an image processing device with at least one driving element for driving a movable element, the locking mechanism comprising a support member disposed between the driving element and the movable element and being movable between a first position and a second position, comprising:

moving the movable element to a predetermined pre-lock position;

setting a predetermined jiggle-down distance for the movable element to move if the locking mechanism is not locked;

moving the movable element to an extreme position of travel; and moving the support member from the first position to the second position to lock the movable element.

18. The method of claim 17, further comprising:

jiggling the movable element between the extreme position of travel and the predetermined jiggle-down distance.

19. The method of claim 17, wherein the movable element is locked in the extreme position of travel.

20. A method of unlocking a locking mechanism in an image processing device with at least one driving element for driving a movable element, the driving element having a clutch, the locking mechanism comprising a support member disposed between the driving element and the movable element and being movable between a locked position and an unlocked position, comprising:

driving the support member in a forward locking direction to store energy when the support member is in the locked position;

at least one of reversing and releasing the clutch while the support member is being driven in the forward locking direction to cause a release of the stored energy; and allowing the support member to move from the locked position to the unlocked position in response to the release of the stored energy.

* * * * *